US005201361A

United States Patent [19]

Grove et al.

[11] Patent Number: 5,201,361

[45] Date of Patent: Apr. 13, 1993

[54] CONTINUOUS CASTING IN MOLD HAVING HEATED END WALLS

[75] Inventors: John W. Grove, Seneca; Frank J. Kowalczyk, Oil City, both of Pa.

[73] Assignee: Acutus Mold, Inc., Pontiac, Mich.

[21] Appl. No.: 685,800

[22] Filed: Apr. 16, 1991

[51] Int. Cl.[5] ..... B22D 11/04

[52] U.S. Cl. ..... 164/459; 164/418; 164/435; 164/471

[58] Field of Search ..... 164/471, 435, 459, 418

[56] References Cited

U.S. PATENT DOCUMENTS 4,516,622 5/1985 Thone et al. ..... 164/436 X

FOREIGN PATENT DOCUMENTS 53-45292 12/1978 Japan ..... 164/471
62-224454 10/1987 Japan ..... 164/418
63-183760 7/1988 Japan ..... 164/459
63-268542 11/1988 Japan ..... 164/471
1-127144 5/1989 Japan ..... 164/435
1-278944 11/1989 Japan ..... 164/418

*Primary Examiner*—J. Reed Batten, Jr.
*Attorney, Agent, or Firm*—Dykema Gossett

[57] ABSTRACT

An improved continuous caster mold having adjustable end walls employs heating mechanisms in the portion of each of the narrow end walls above the level of molten metal contained in the mold to heat that portion of each of the end walls to a temperature more closely approximating the temperature of the end walls below the level of molten metal in the mold. The heating mechanisms tend to lower the temperature differential between the portion of the end wall below the level of molten metal and the portion of the end wall above the level of molten metal. By equalizing the temperature differential in the end wall, the thermal expansion of the end wall is made more uniform to prevent the formation of a gap between the end walls and either of the broad side walls. The improvement is also useful for reducing thermal stresses in molds having fixed, stationary end walls.

1 Claim, 3 Drawing Sheets

CONTINUOUS CASTING IN MOLD HAVING HEATED END WALLS

BACKGROUND OF THE INVENTION

The present invention relates to continuous caster molds having an opposed pair of broad walls and an opposed pair of adjustably spaced narrow walls and more particularly to such a continuous caster mold having heated end walls for minimizing edge gap.

In the continuous casting of steel, it is known to utilize molds having a pair of opposed broad walls and a pair of opposed narrow walls in which at least one of the narrow walls is adjustable for changing the width of the slab during the actual casting operation. Normally, the thickness of the slab being cast on currently existing casters is within the range of 6–10 inches (15–25 cm). For slabs of this thickness, the mold walls are essentially rectangular so that the opening or cavity in the mold has straight sides. Molten metal is introduced into the mold from a tundish or ladle through a refractory pouring tube. The level of molten metal within the mold is maintained at a predetermined level below the top of the mold, generally on the order of 4–5 inches (10–13 cm).

The broad and narrow walls are generally made of a relatively thin copper or copper alloy plate attached to a relatively thick steel backup plate for support. The walls are cooled by the flow of water through channels in the back of the copper plates and in the backup plates. The molten metal in contact with the water cooled walls solidifies, permitting a partially solidified slab to be drawn out of the bottom of the mold as molten metal is introduced into the top of the mold.

The molten metal is on the order of 2800°–2900° F. (1540°–1590° C.). The hottest portion of the mold is the portion immediately beneath the surface or meniscus of the molten metal. The contact between the molten metal and the end wall at the meniscus heats the surface of the end wall and causes the end wall to expand.

However, immediately above the meniscus, no molten metal is in contact with the end wall but cooling water is in contact with the rear surface of the end wall. Therefore, an extreme temperature differential exists in the end wall between the portion of each end wall immediately below the meniscus and that immediately above the meniscus. The cooler metal above the meniscus expands only a fraction as much as the hot portion of the end wall in contact with the molten metal. The expansion of the end wall just beneath the meniscus urges the broad walls slightly farther apart in this area. Since the side walls are rigid and the upper portion of the end wall does not expand with the portion of the end wall beneath the surface of the molten metal, a gap forms between the upper portion of the end wall and the broad walls. While this gap is not initially serious, flux, molten metal and other contaminants can enter the gap. Continued service or prolonged casting can lead to a buildup of contaminants which will widen the gap. Width changes to the mold, during which the end walls are moved with respect to the casting direction, can also lead to buildup of contaminants and widening of the gap. Combination of the factors contributing to buildup of the contaminants can eventually cause breakouts or early stoppage of casting.

What is needed is a method and apparatus for equalizing the temperature of the end wall above the level of molten metal in the mold with that below the surface of the molten metal to prevent edge gap related casting problems.

SUMMARY OF THE INVENTION

An improved mold for continuously casting a metal slab has a pair of fixed opposed broad walls, a pair of adjustable opposed narrow walls sealingly engaging the broad walls, and a mechanism for adjusting the spacing of the narrow walls with respect to the casting direction. Moreover, the mold is adapted to receive molten metal in a top portion to a predetermined level, to solidify the molten metal in contact with the broad and narrow walls in a middle portion and to emit a partially solidified slab from a bottom portion, the improvement comprising heating devices mounted in each of the narrow mold walls for increasing the temperature of the portion of each of the narrow mold walls above the predetermined level of molten metal within the mold.

BRIEF DESCRIPTION OF THE DRAWINGS

The invention will be more clearly understood from the following description in conjunction with the accompanying drawings, wherein.

DETAILED DESCRIPTION OF THE PREFERRED EMBODIMENTS

Figure 1:
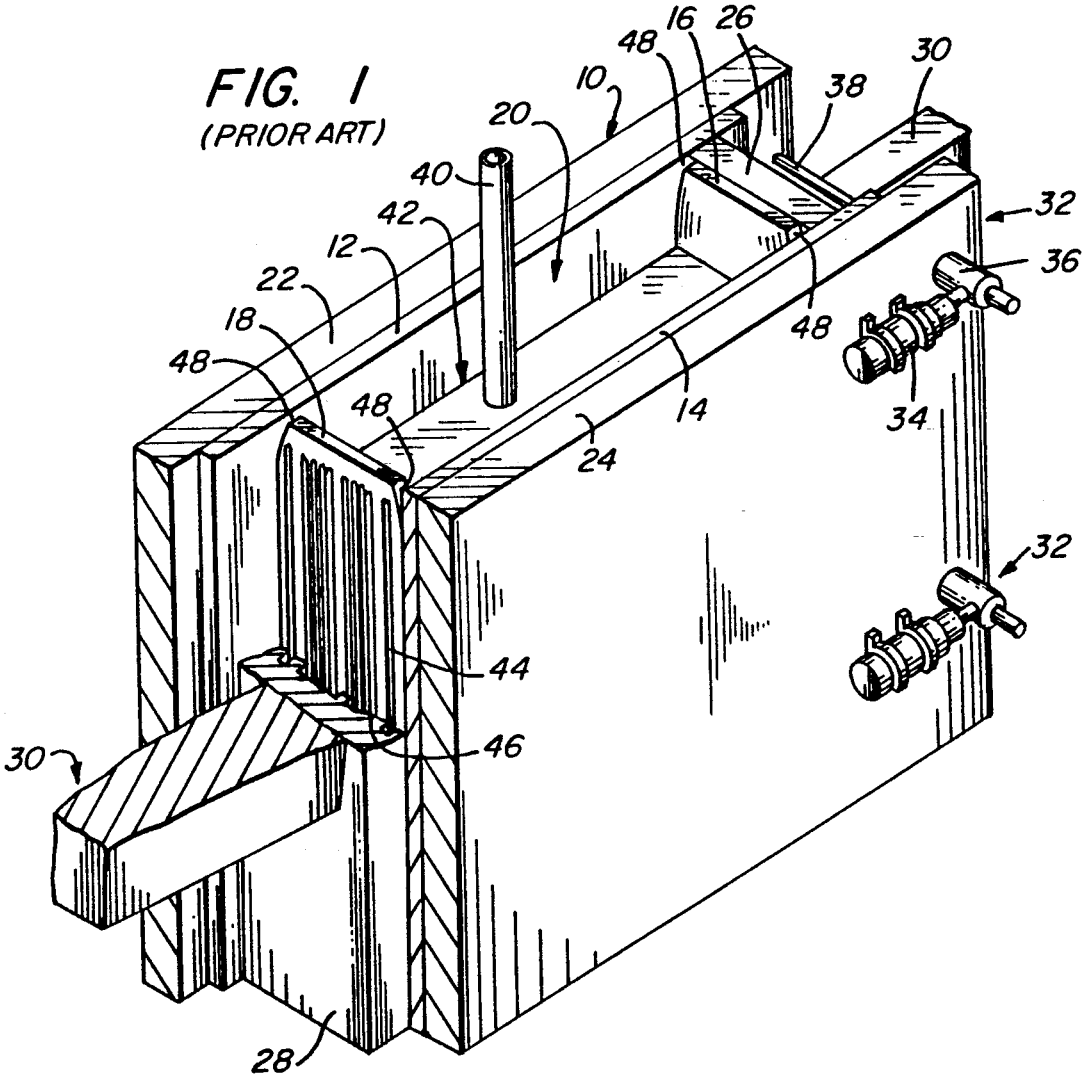
FIG. 1 (PRIOR ART)
FIG. 1 is an isometric view with parts broken away of a continuous caster mold according to the prior art.

FIG. 1 illustrates a conventional continuous caster mold 10 having movable end walls but without the improvement according to the invention. Continuous caster mold 10 comprises broad side walls 12 and 14 and narrow end walls 16 and 18 which form a rectangular mold cavity 20. Broad walls 12, 14 and narrow walls 16, 18 are made of copper or a copper alloy and are supported by broad wall backup plates 22 and 24 and narrow wall backup plates 26 and 28 respectively. End walls 16 and 18 are movable with respect to the casting direction through an end wall adjustment mechanism, such as adjustment beam 30.

The spacing of end walls 16 and 18 is set based upon the width of the slab to be cast and end wall clamping mechanism 32 is activated to clamp the end walls 16 and 18 firmly between side walls 12 and 14 and in sealing engagement therewith. End wall clamping mechanism 32 preferably includes a gear motor 34 coupled to a screwjack 36 which drives a jackstem 38. A spring assembly (not shown) is provided on the opposite side of the mold from gear motor 34 and about jackstem 38 for biasing wide mold wall 12 against narrow mold walls 16 and 18. A load cell (not shown) is preferably mounted on the jackstem 38 between the spring assembly and backup plate 22 of mold wall 12 for monitoring the amount of force being exerted on end walls 16 and 18 to prevent damage to the relatively thin copper walls.

Molten metal is poured into the caster mold 10 through pouring tube 40 to a predetermined level with meniscus 42 being about 4 inches (10 cm) below the top surface of the mold. A discharge opening (not shown) of refractory pouring tube 40 is beneath the surface of the molten metal within mold cavity 20. Heat is removed from the molten metal by water flowing through the continuous caster mold 10. Backup plate 28 is partially cut away to reveal cooling channels 44 in the back surface of end wall 18. End wall 16 and broad walls 12 and 14 are similarly provided with cooling water channels. The backup plates can be similarly provided with cooling channels such as cooling channels 46 shown on end wall backup plate 28. Cooling channels 46 supply cooling water to the cooling channels 44 and end wall 18 with the cooler water entering near the bottom and exiting near the top of the mold.

Molten metal introduced into mold cavity 20 through pouring tube 40 is on the order of 2800°-2900° F. (1540°-1590° C.). The hottest portion of the mold is the portion immediately beneath the meniscus 42. Once the molten metal begins solidifying against the water cooled broad walls and end walls farther down within the mold, the solidifying metal acts to insulate the water cooled walls from the molten metal within the shell being formed. The hot molten metal in contact with end walls 16 and 18 heats the portion of end walls 16 and 18 immediately beneath the surface of the molten metal to a relatively high temperature. In contrast, the portions of end walls 16 and 18 above the surface of the molten metal are not subjected to the same high temperatures as are the portions below the surface of the molten metal. Due to the high temperature of the portion of the end wall beneath the surface of the molten metal, this portion has a high level of thermal expansion. The high level of thermal expansion of the end walls 16 and 18 immediately beneath the surface of the molten metal acts to push against the spring assembly to urge broad mold walls 12 and 14 farther apart at this level of the mold. However, the portion of the end walls 16 and 18 immediately above that level is not at as high a temperature and does not experience as high a level of thermal expansion. Due to the difference in the temperature of end walls 16 and 18 above the level of molten metal versus that below the level of molten metal, the portion of end walls 16 and 18 beneath the level of molten metal expands in a greater rate than the portion of end walls 16 and 18 above the molten metal. This difference in the thermal expansion of the end walls 16 and 18 above and below the level of the molten metal leads to the formation of a gap 48. This gap 48 permits flux and other contaminates to deposit along the edge of end walls 16 and 18.

Figure 2:
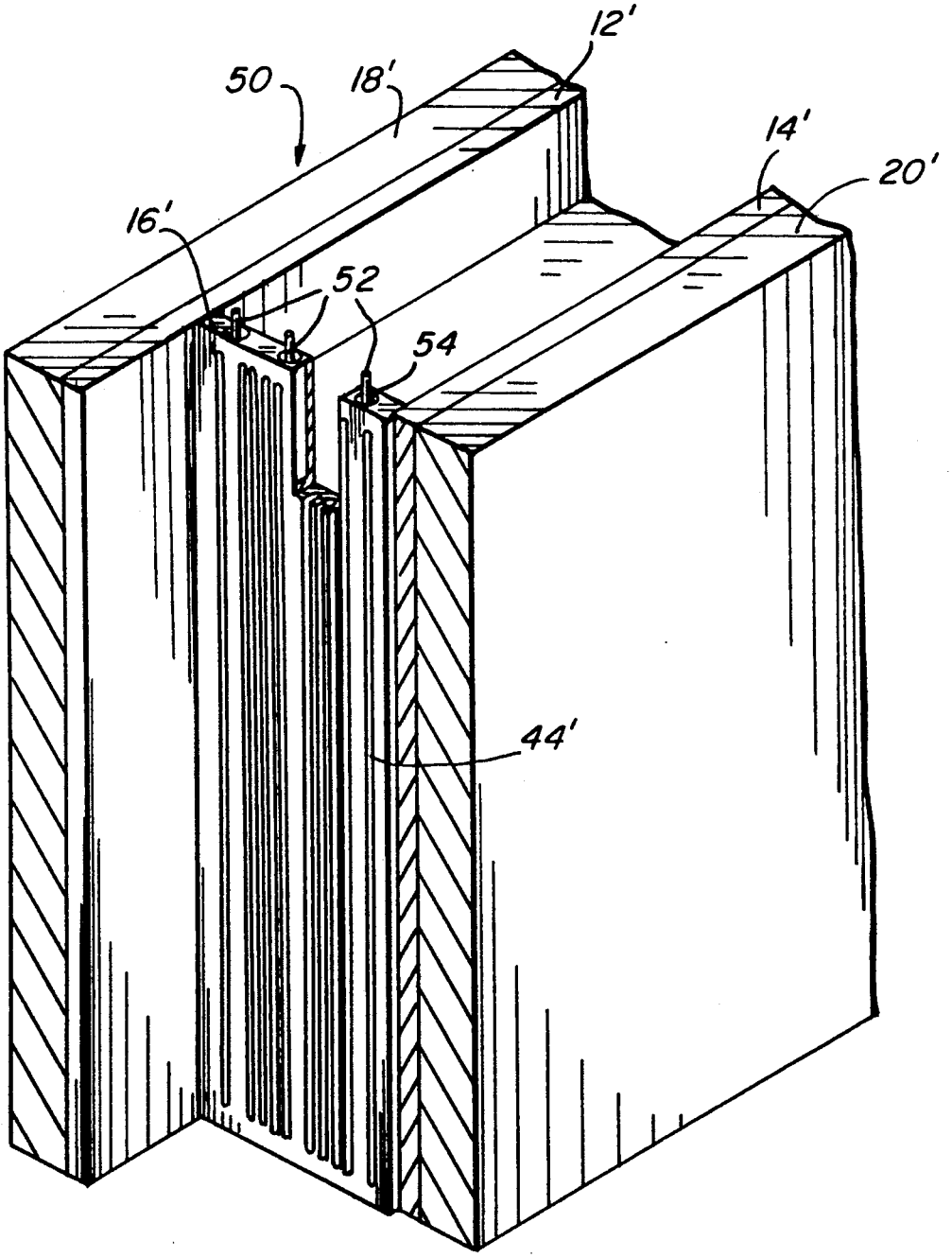
FIG. 2 is an isometric view with parts broken away of one embodiment of a continuous caster mold according to the present invention; and, FIG. 3 is an isometric view with parts broken away of a second embodiment of a continuous caster mold according to the invention.

FIG. 2 illustrates a preferred embodiment of the continuous caster mold 50 according to the invention. Like mold 10 of FIG. 1, mold 50 has broad side walls 12' and 14' and narrow end walls, only one of which 16' is illustrated. Backup walls 18' and 20' support the broad mold walls 12' and 14' while backup walls (not shown) support the end walls. Cooling channels 44' provide cooling water to the back surface of end wall 16' for removing heat from the molten metal therewithin. The predetermined level of molten metal in mold 50 is on the order of 4 inches (10 cm) below the top surface of mold 50. In order to equalize the temperatures of the end wall portions above the level of molten metal with those below the level of molten metal, the invention provides for the use of heating devices. The preferred heating devices are rod-like heaters 52 which are mounted in receiving orifices 54 within each of the end walls, as illustrated for end wall 16', in portions thereof which do not have cooling channels 44'. These devices can use any form of heating, such as induction or resistance. The heating devices are used to increase the temperature of the portion of the end walls above the level of molten metal in the mold to a temperature more closely approximating that in the end walls below the level of molten metal in the mold to prevent the high thermal differential which results in a differential linear expansion of the end walls and creates a gap between the end walls and the side walls.

Figure 3:
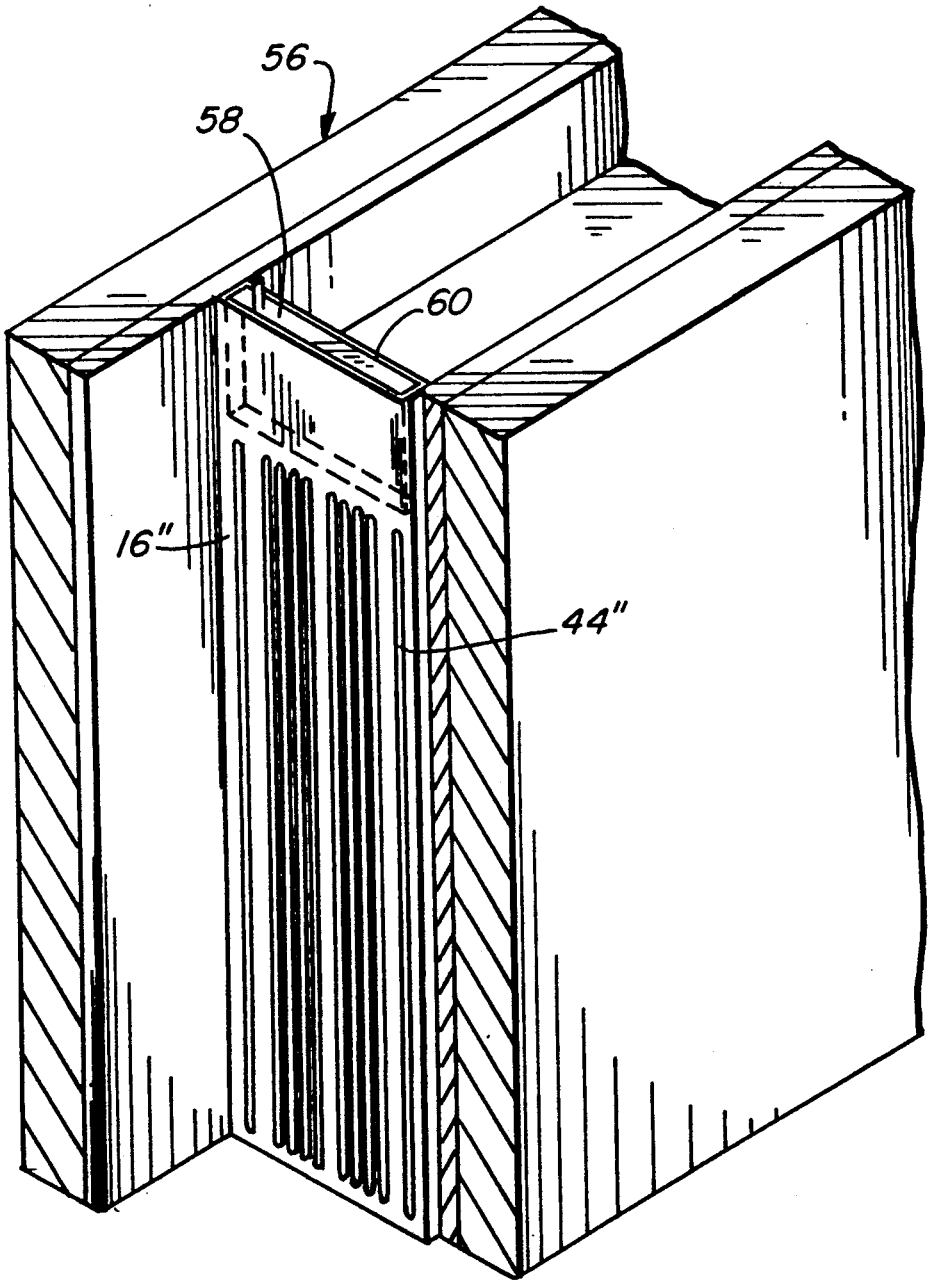

FIG. 3 illustrates an alternate embodiment of the heating mechanism according to the invention. In this figure, the portion of end wall 16" above the level of molten metal in the mold 56 is heated through a plate-type heating mechanism 58. This heating mechanism 58, which is mounted within cavity 60, heats the entire width of the narrow wall 16" from the top of the mold to the level of molten metal within the mold. Due to the configuration of the heating member 58, cooling channels 44" are not provided in the upper portion of the end wall 16". As with the heating mechanisms of FIG. 2, heating mechanism 58 can employ any conventional heating system, such as induction resistance heating or quartz heating elements. Heating of different configurations would be useful with appropriate adaptation of the end wall receiving orifices 54 or cavity 60. Also, heating mechanisms other than induction or resistance heating could be effectively employed.

While the end walls immediately beneath the surface of the molten metal are in contact with metal on the order of 2800°-2900° F., (1540°-1590° C.) they are also water cooled from their rear surfaces. The actual temperature of the surface of the end wall below the meniscus is on the order of 650° F. (340° C.). Above the level of molten metal, the end wall may be only about 100° F. (38° C.). The heating mechanisms according to the invention are employed to raise the temperature of the portion of the end walls above the surface of the molten metal to at least 400° F. (200° C.). At that temperature level, the difference between the end wall temperature above and below the meniscus (typically in the range of about 0° F. to about 250° F.) is low enough that the thermal expansion between the two areas is not significantly different so that no gap is created between the end walls 16', 18' and side walls 12', due to the thermal gradient.

The invention has been described as applied to a particular variable width mold. The invention is equally useful on molds having fixed, stationary end walls to relieve thermal stresses therewithin as well as in other designs of variable width molds.

We claim:

1. A method of casting a metal slab from a continuous casting mold having a pair of fixed and opposed broad walls and a pair of opposed narrow walls, said broad and narrow walls cooperating to form a molten metal reception cavity adapted to receive molten metal to a predetermined level, said predetermined level being below a certain portion of each of said pair of opposed narrow walls, said method cooling said received molten metal effective to form a continuous slab; and locally and continuously applying heat to said certain portion of each of said pair of opposed narrow walls only above said predetermined level, effective to create thermal expansion of said certain portion and thereby prevent the formation of a gap between one of said pair of narrow walls and one of said pair of broad walls as said received molten metal is cooled and formed into said slab.

* * * * *